US008191678B2

(12) United States Patent
Zou

(10) Patent No.: US 8,191,678 B2
(45) Date of Patent: Jun. 5, 2012

(54) APPARATUS FOR ABSORBING ACOUSTICAL ENERGY AND USE THEREOF

(75) Inventor: Siwei Zou, Rohnert Park, CA (US)

(73) Assignee: SE Electronics International, Inc., Rohnert Park, CA (US)

( * ) Notice: Subject to any disclaimer, the term of this patent is extended or adjusted under 35 U.S.C. 154(b) by 180 days.

(21) Appl. No.: 12/161,274

(22) PCT Filed: Jan. 12, 2007

(86) PCT No.: PCT/US2007/060511
§ 371 (c)(1),
(2), (4) Date: Jul. 17, 2008

(87) PCT Pub. No.: WO2007/084860
PCT Pub. Date: Jul. 26, 2007

(65) Prior Publication Data

US 2008/0302599 A1 Dec. 11, 2008

(51) Int. Cl.
*E04B 1/82* (2006.01)

(52) U.S. Cl. ..... 181/290; 181/284; 181/286; 381/189; 381/359; 381/362; 381/354; 381/353

(58) Field of Classification Search ..... 181/290, 181/292, 284, 286
See application file for complete search history.

(56) References Cited

U.S. PATENT DOCUMENTS 1,675,102 A * 6/1928 Holland ..... 181/30
1,682,409 A * 8/1928 Nyman ..... 381/352
1,914,099 A * 6/1933 Bedell ..... 181/176
2,017,122 A 10/1935 Hanson
4,106,587 A 8/1978 Nash et al.
4,214,411 A 7/1980 Pickett
4,433,021 A * 2/1984 Riel ..... 428/116
4,570,746 A * 2/1986 Das et al. ..... 381/359
4,625,827 A 12/1986 Bartlett
4,805,728 A 2/1989 Carter et al.
4,967,874 A * 11/1990 Scalli ..... 181/158
4,975,966 A 12/1990 Sapiejewski
5,009,043 A 4/1991 Kurrasch
5,469,932 A 11/1995 McNair
5,525,766 A 6/1996 Atcheson et al.
5,796,368 A 8/1998 Arthur, III
6,179,943 B1 1/2001 Welch et al.

(Continued)

FOREIGN PATENT DOCUMENTS

AU 2005100255 A4 5/2005

(Continued)

OTHER PUBLICATIONS http://www.auralex.com/sound_isolation_xpanders/sound_isolation_xpanders.asp.

(Continued)

*Primary Examiner* — Forrest M Phillips
(74) *Attorney, Agent, or Firm* — Gard & Kaslow LLP

(57) ABSTRACT

An apparatus comprising a combination of a microphone and a composite acoustic panel. The composite acoustic panel comprises materials having different spectra of acoustic absorption. The materials may be integrated in a single layer or in a plurality of different layers.

23 Claims, 3 Drawing Sheets

U.S. PATENT DOCUMENTS

| | | | | |
|---|---|---|---|---|
| 6,244,378 | B1 * | 6/2001 | McGrath | 181/292 |
| 6,584,736 | B2 | 7/2003 | Szymanski et al. | |
| 6,595,321 | B1 | 7/2003 | Tompson | |
| 7,178,630 | B1 * | 2/2007 | Perdue | 181/290 |
| 2002/0139066 | A1 | 10/2002 | Szymanski et al. | |
| 2003/0006090 | A1 | 1/2003 | Reed | |
| 2003/0029670 | A1 | 2/2003 | Smith et al. | |
| 2004/0099476 | A1 | 5/2004 | Swift et al. | |
| 2004/0183775 | A1 | 9/2004 | Bell | |
| 2004/0238275 | A1 | 12/2004 | Keller et al. | |
| 2005/0271233 | A1 * | 12/2005 | Uchimura | 381/359 |
| 2006/0124388 | A1 * | 6/2006 | Pompei | 181/290 |

FOREIGN PATENT DOCUMENTS

| | | | |
|---|---|---|---|
| FR | 2827419 | A1 | 1/2003 |
| GB | 391667 | A | 5/1933 |
| JP | 2005351957 | * | 12/2005 |

OTHER PUBLICATIONS

Acoustic Treatment for Home Studios, Peter Elsea, 1996.

International Search Report and Written Opinion for PCT/US07/60511, dated May 6, 2008.

* cited by examiner

APPARATUS FOR ABSORBING ACOUSTICAL ENERGY AND USE THEREOF

TECHNICAL FIELD

The present invention relates to an apparatus for the absorption of acoustical energy. Specifically, the present invention relates to an acoustic panel of a shape engineered for a particular use, and acoustical panels of a particular composition of layered material.

BACKGROUND ART

Acoustic panels have long been used to change the acoustic qualities of a particular space, such as a room, or a professional environment, for example a studio, auditorium, theater or stadium. The primary use of acoustic panels is in professional environments, where the acoustical characteristics are sufficiently critical to require extraordinary treatment and use of specialized devices to achieve the acoustic quality. However, many uses of acoustical panels now include interior and exterior locations in homes, offices and commercial spaces where acoustical characteristics are not as critical as in a professional environment.

The sound that is received through a device that converts sound waves into electrical signals for recording (hereinafter referred to as a "microphone") in any room, is a combination of the direct sound that travels straight from the primary sound source to the microphone, and the indirect reflected sound, including the sound from the primary sound source, that bounces off the walls, floor, ceiling, or objects in the room before it reaches the microphone.

Reflected sounds can be considered either "good" or "bad". Reflected sounds may be considered good when they make music and speech sound fuller and louder than they would otherwise. Reflected sound may also add a pleasant spaciousness to the recorded sound. However, reflected sound may be considered bad if they distort the recorded sound by making certain notes sound louder while canceling out other sounds. The recorded sound may result in midrange or high frequencies that are too sharp or harsh or may result in an echo. Likewise low frequency sound, such as bass notes, can be boomy.

DISCLOSURE OF INVENTION

Technical Problem

Reflected sounds can also affect the tonal quality, particularly of musical instruments. For example, a flute and an oboe have different tonal qualities. Each instrument should sound differently even playing the same note, because each instrument's tones have a different harmonic structure. Reflected sound from these instruments may obscure such distinctions.

Some reflected sound is often necessary for music and speech to sound natural, but too much reflected sound may distort and diminish the quality of the recorded sound. One can control the amount of reflected sound by absorbing or by diffusing these reflections.

Reflected sound may also be unwanted simply because the intrinsic 'sound' of the room in which the recording is being made is undesirable.

To achieve the desired acoustical characteristics of an acoustic quality critical space, musicians and those who own the sound-critical spaces have long employed a variety of acoustic devices, such as acoustic panels, often made of foam, to enhance the acoustic qualities of the space. Multi-layered sound absorbing panels for such use are also known. These acoustic panels come in a wide variety of shapes and sizes. Although many of the acoustic panels are designed for general purpose use, some of the acoustic panels are designed for more special application, or to perform more specific functions. Different types of acoustic panels that exist include base trap panels that are designed especially for absorbing low-range, base sounds; corner panels that are designed to fit easily into corners of rooms; broad-band absorbers that are designed to absorb sound over a wide range of frequencies; and wedge-type absorbers that are especially useful for spot treating certain areas in spaces.

It should also be noted that acoustic panels employ a wide variety of facial configurations, with some facial configurations being adapted to perform certain functions, while other facial configurations are designed with primarily aesthetic considerations in mind. Other sound treatments are designed to not only absorb sound, but also to defuse sound over a given area. Further, some sound-absorbing panels are used primarily as sound and vibration insulators that are between a pair of hard surfaces, such as speaker cabinet and a floor to acoustically isolate two hard members from each other, to thereby reduce the likelihood that vibrations of one hard member will cause vibrations in the second hard member. Further, hard and/or dense, non-foam type acoustic panels exist that are used primarily to provide sound barriers between adjacent spaces.

In the recent past, musicians or other sound recording persons who desire to obtain a studio-quality recording were often forced to make a recording in a specially-designed studio. This requirement existed not so much because of the acoustic properties of the room, but rather resulted from the significant expense required to obtain studio-quality electronic recording equipment, such as multi-track tape recorders, mixers and the like. Recently, sound recording technology has tended to change from the conventional analog equipment to digital recording equipment. Concurrently, low cost personal computers have become sufficiently powerful so as to be able to process large amounts of digital data. These two technological developments have resulted in studio-class, high quality recording equipment being obtainable at a price that is affordable by persons such as musicians, personalities, voice talents and recording engineers. As such, the relatively low cost and small size of current state-of-the-art recording equipment has permitted many musicians, voice talents and other persons to set up 'home studios' in their homes, apartments or office spaces, that have electronic recording equipment that is capable of making high-quality "studio grade" recordings.

The installation of acoustic panels in a room often requires the dedication of the entire room to the use as a studio or other specialized purpose requiring the manipulation of acoustical characteristics. Such a dedicated used may be acceptable to those having a sufficient amount of space for a dedicated room, or when the acoustical characteristics do not require special attention. It is known in the art to provide an acoustic panel in the form of a block of foamed polymer material which can be used behind a microphone to enable it to be used in a room which has not been acoustically treated or adapted in any way. However, this approach is insufficient to allow high quality recordings to be made. One object of the present invention is therefore to provide an acoustic panel that lends itself to temporary installation in combination with a microphone in a room or other environment, while providing high quality, preferably up to studio-quality, acoustical performance and characteristics.

Technical Solution

Accordingly, the general purpose of the invention is to filter out and absorb acoustical energy generated from a primary sound source and as it is reflected from room surfaces to a microphone. The acoustic panel preferably contains a main body consisting of one or more layered materials, where such materials exhibit varying filtering or reflecting characteristics, an in any combination thereof, coupled together with an attachment means. The acoustic panel preferably also contains a mounting means to attach the acoustic panel to a microphone stand or boom.

Thus, a first aspect of the present invention now provides a combination of a microphone and a composite acoustic panel.

One preferred class of embodiments of the present invention comprises a main body consisting of an acoustic panel made from a first layer, a second layer, a third layer, a fourth layer, a fifth layer, and a sixth layer, coupled together with an attachment means. The first layer preferably comprises a semi-rigid aluminum fibre material of varying thickness and of varying density to pass acoustic energy, in any combination thereof, as a protective screen and to maintain the engineered shape. The second layer preferably comprises woolen felt of varying thickness and absorption characteristics, in any combination thereof. The third layer is preferably aluminum film of varying thickness and of varying density, or any combination thereof, to pass of reflect acoustic waves. The fourth layer preferably is in the form of a space of any desired width. The fifth layer preferably comprises woolen felt of varying thickness and absorption characteristics and any combination thereof. The sixth layer preferably comprises a semi-rigid aluminum fibre material of varying thickness and of varying density to pass acoustic waves, in any combination thereof, as a protective screen and to further maintain the engineered shape.

Another aspect of the present invention comprises an acoustic panel configured in the shape of a half cylinder with a main body portion containing an acoustical material, and consisting of a front surface, a rear surface, a top surface, a bottom surface, a right surface, and a left surface. The present invention, configured as a half cylinder, absorbs incident acoustical energy substantially normal to its front surface. The real surface of this embodiment further absorbs acoustical waves, including the reflections of acoustical waves emanating from the primary sound source from the surfaces of the space.

Another aspect of the present invention comprises an acoustic panel configured in the shape of a parabola with a main body portion containing an acoustical material, and consisting of a front surface, a rear surface, and an end surface the entire circumference of the parabola. The present invention, configured as a parabola absorbs acoustical energy incident thereon, from a direction substantially along the parabolic axis.

Another aspect of the present invention provides an acoustic panel configured as a flat panel with a main body portion containing an acoustical material, and consisting of a front surface, a rear surface, a top end, a bottom end, a first end and a second end. The present invention, configured as a flat panel, absorbs acoustic energy incident substantially normal to the front face thereof.

A further aspect of the present invention provides a method of adjusting the acoustic response of a microphone, the method comprising the steps of providing the microphone and positioning at a predetermined position relative to the microphone, a composite acoustic panel.

A further embodiment of the present invention comprises an acoustic panel configured in the shape of a half cylinder with a main body portion containing an acoustical material, and consisting of a front surface, a rear surface, a top surface, a bottom surface, a right surface and a left surface, and a second body portion containing multiple panels of an acoustical material attached to the front surface of the main body portion. The panels of the second body portion define an additional air gap between the main body portion and the second body portion.

In accordance with other aspects of the invention, one or more of the acoustic panels, may be arranged in respect of the recording device and primary sound source at the discretion of the user. An acoustic panel of the present invention, when configured as a half cylinder or a parabola, may be positioned with the recording device at the center point of the curvature of the acoustic panel, with the primary sound source directly opposite the acoustic panel from the recording device, to eliminate reflections of acoustical waves from a 180 degree direction. The panel may also be placed at various distances from the recording device and at various positions relative to the primary sound source. The reflecting performance of the acoustic panel will differ according to its position relative to the recording device and the primary sound source, providing the user a wide range of acoustical effects. The reflecting performance of the acoustic panel will further differ with the addition of the second body portion which provides further absorption of acoustical energy and reflection of acoustical energy away from the microphone.

Another feature of the present invention is that the acoustic panel is designed to be removably mountable to a recording device by a mounting means, whether such recording device is positioned on a boom or on a stand. The acoustic panel is also designed to be mountable to a separate stand or boom by a mounting means, includes a movable and jointed mounting arm, to provide for the maximum flexibility to determine the position of the acoustic panel with respect to the recording device and sound source.

As used herein, 'acoustic energy' refers to sound energy, whether of audible or inaudible frequency and includes sound of single frequency or any spectrum or other combination of frequencies.

The apparatus according to the present invention comprises the microphone and the composite acoustic panel. The microphone and panel may be mounted separately, but in relatively close proximity to each other. However, in a preferred class of embodiments, the microphone and panel are mounted on a common support, for example a microphone boom or microphone stand to which is attached, a support for the panel. In this way, the panel may conveniently be fixed at any relative appropriate distance from the microphone. Preferably, the composite panel contains two or more different materials which have different acoustic absorption characteristics, i.e. they preferably absorb at different frequencies or over different parts of the frequency spectrum. Such materials may include air, in the form of an air gap as will be described in more detail hereinbelow.

The different materials may be incorporated in the same one or more layers and/or respectively in different layers. Thus, the panel may comprise two layers, respectively comprising a first material and a second material, the first material and the second material being capable of absorbing respective acoustic frequencies which differ from each other.

The panel may comprise three or more layers, any or each having a composition differing from the others.

In a particular preferred arrangement, the panel may comprise at least two solid layers which are separated by an air gap layer. For example, it may comprise two solid layer groups, each layer group comprising one or more layers, the solid layer groups being separated by an air gap layer. It is also possible to have more than one air gap, there then being three or more solid layer groups.

In one preferred class of embodiments, comprising solid layers or solid layer groups separated by an air gap layer, at least one of the solid layer groups is provided with a diffusion layer, for example of a perforated material such as of a plastics substance or a metallic substance, for example aluminum. Any solid layer structure preferably comprises or consists of a solid sound absorptive layer such as of a non woven or other fibrous structure, for example of woolen fibres, metallic fibres, plastics fibres, or any mixture thereof. Additionally or alternatively, it may comprise or consist of a foamed material such as a foamed polymer and/or foamed metal (such as foamed aluminum).

The acoustic panel may for example absorb at least 10%, preferably at least 20%, more preferably at least 30%, still more preferably at least 40%, yet more preferably at least 50% of incident sound energy having a substantially uniform intensity across the range from 100 Hz to 8 kHz (or at a reference frequency of 1 kHz), for example incident upon the panel from the direction of the microphone.

Typical thicknesses for any solid layer or group of solid layers are preferably from 0.1 mm to 20 cm, more preferably from 0.5 mm to 10 cm. Preferred thicknesses of air gap layers typically range from 1 mm to 20 mm, more preferably from 2 mm to 5 mm.

The acoustic panel may be any convenient shape, for example planar or curved. Any curvature is preferably concave when facing the microphone. Where the curvature has a point of focus or axis of symmetry, the microphone is preferably placed substantially at that focus or substantially on that axis. The curvature may be semicircular, hemispherical, parabolic or any other kind.

When viewed from the direction of the microphone, the profile area of the panel is typically from 50 $cm^2$ to 1 $m^2$, more preferably from 100 $cm^2$ to 0.5 $m^2$.

The acoustic panel may be positioned any suitable distance from the microphone. For example, the minimum distance between that part of the microphone body which receives sound to pass it though to the transducer (e.g. wind shield, perforated microphone body part etc.) and the panel could be from 5 cm to 100 cm, such as from 10 cm to 50 cm or from 10 cm to 30 cm.

Any aspect of the present invention may optionally comprise any one or more essential, preferred or example feature of any other aspect of the present invention, unless the context would specifically forbid. As regards the appended claims, the features of any dependent claim may be combined with the features of any one or more other dependent claim, unless the context forbids.

Advantageous Effects

As described above, in accordance with the present invention, a center portion of a back electret is subjected to a series of processes such as a pressing to render a surface of a high molecular film of the back electret opposing a diaphragm into a concave surface similar to a vibrating form of the diaphragm so that a conversion of a displacement of the diaphragm to an electrical signal is maximized to improve sensitivity and that the spacer for forming an insulation space is eliminated to reduce the number of components and the manufacturing cost.

While the present invention has been particularly shown and described with reference to the preferred embodiment thereof, it will be understood by those skilled in the art that various changes in form and details may be effected therein without departing from the spirit and scope of the invention as defined by the appended claims.

DESCRIPTION OF DRAWINGS

Various objects, features and advantages of the present invention will become fully appreciated and better understood when considered in conjunction with the following description of preferred embodiments and with reference to the accompanying drawings, in which.

BEST MODE

Figure 1:
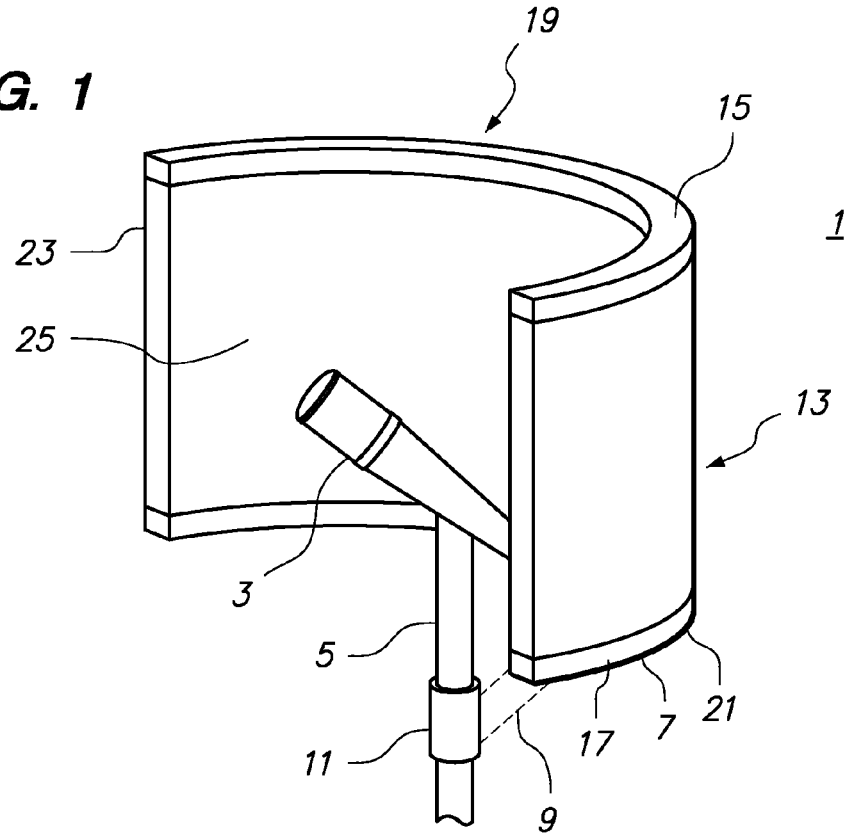
FIG. 1 shows a perspective view illustrating a first embodiment of the present invention configured as a half cylinder.

FIG. 1 shows a perspective view of a first embodiment of an apparatus 1 according to the present invention. The apparatus 1 comprises a microphone 3 supported on a stand 5. The apparatus 1 further comprises an acoustic panel 7. The acoustic panel 7 is supported on a strut 9, behind the microphone 3. The strut 9 is attached to the stand 5 by means of a collar 11. The acoustic panel 7 comprises a composite acoustic absorbing structure 13 which is held between an upper peripheral support 15 and a lower peripheral support 17.

As shown in FIG. 1, the acoustic panel 7 has flat upper 19 and lower 21 edges and flat (straight) side edges 23 and 27. However, the body of the panel is parabolic in the manner that the upper 19 and lower 21 edges are semicircular, the semicircular shape being concave towards the microphone, creating a concave face 25.

Mode for Invention

Figure 2:
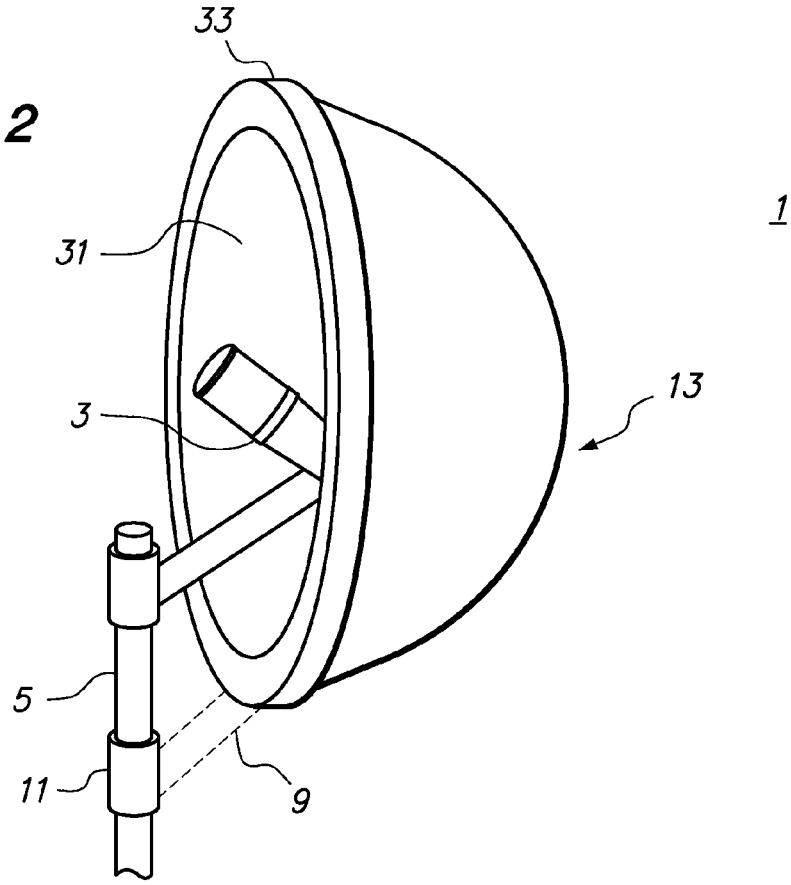
FIG. 2 shows a perspective view illustrating a second embodiment of the present invention configured as a parabola.

The embodiment show in FIG. 2 is generally analogous to that shown in FIG. 1 and the same reference numerals are used to denote like integers. However, the acoustic panel 13 is parabolic so as to have a concave opening 31 facing the back of the microphone. The composite acoustic member 13 is supported on a circular peripheral rim 33 which is analogous to the support members 15 and 17 in FIG. 1.

A third embodiment is shown in FIG. 3, which is again analogous to the embodiment shown in FIGS. 1 and 2 and therefore, identical reference numerals are used for like integers. In this case, the composite acoustically absorbing member 13 is rectangular and substantially flat.

Figure 3:
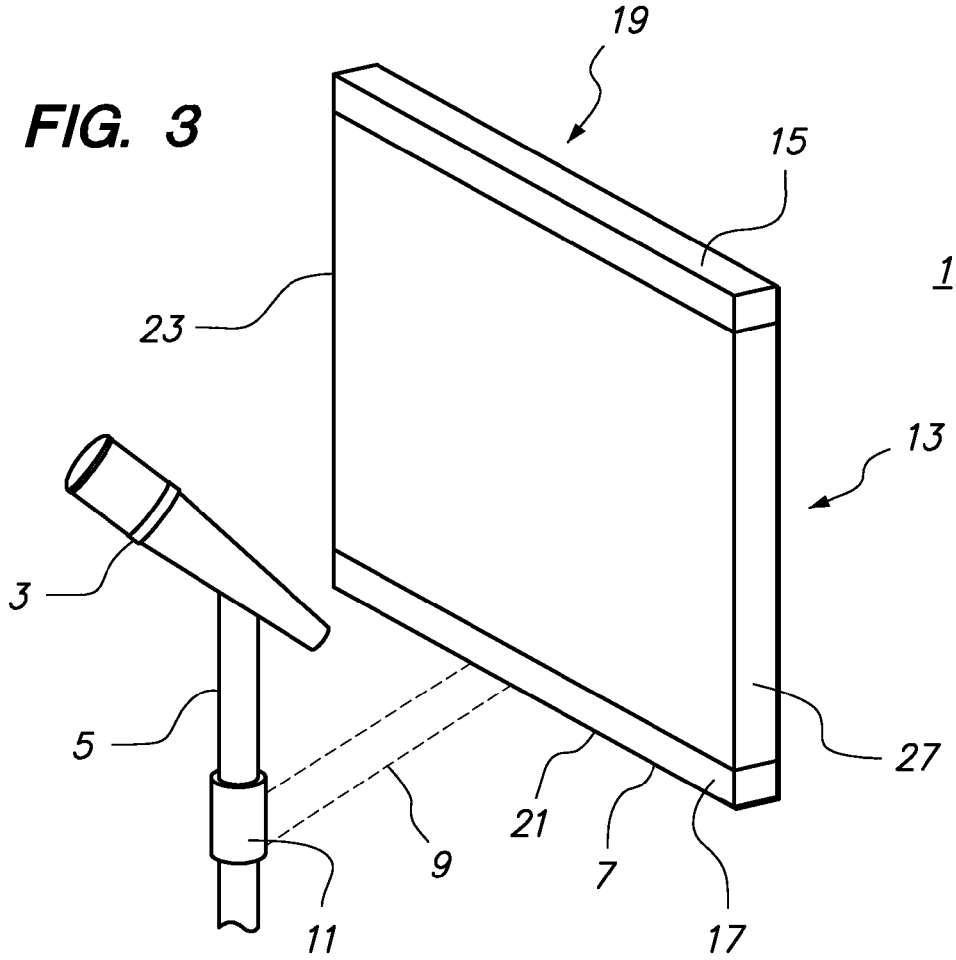
FIG. 3 shows a perspective view illustrating a third embodiment of the present invention configured as a flat panel.
Figure 4:
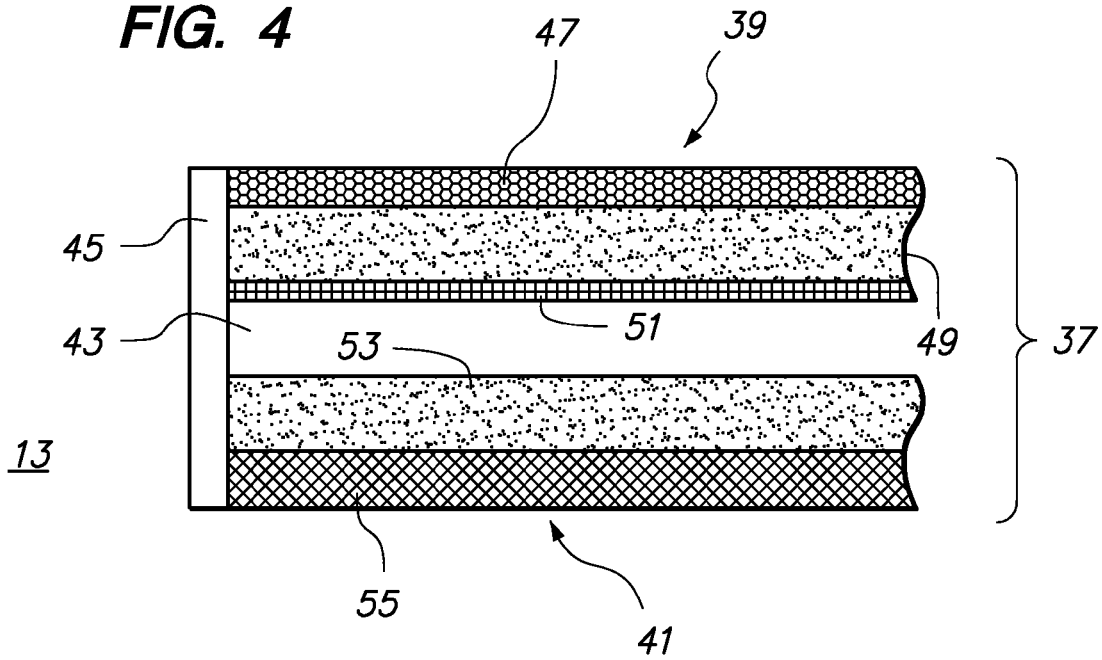
FIG. 4 shows a part sectional view illustrating the layers of materials of the preferred embodiment of the acoustic panel show in FIG. 3.

FIG. 4 shows a partial cross-section though the composite acoustic absorbing member 13 shown in FIG. 3 but it can readily be appreciated that essentially the same layer structure will apply to the embodiments of FIGS. 1 and 2.

As shown in FIG. 4, the layer structure 37 of the acoustical energy absorbing member 13 comprise a rear solid layer structure 39 and a front solid layer structure 41. These rear and front layer structures 39, 41 are substantially parallel with each other but separated by an air gap 43. The layer structures 39 and 41 with the air gap 43 therebetween are maintained in this position by a peripheral frame member 45.

The rear layer structure 39 comprises an outer punched aluminum layer 47. Immediately below this punched aluminum layer 47 is disposed in direct contact therewith, a wool fibre layer 49. Beneath the wool fibre layer 49 and in direct contact therewith, is an aluminum foil layer 51 constituting the third layer of the rear solid layer structure 39.

The front solid layer structure comprises another wool fibre layer 53 directly facing the air gap layer 43 and the aluminum foil layer 51 of the rear solid layer structure 39. This second wool fibre layer 53 of the front layer structure 41 is faced on the outward surface thereof, with a further punched aluminum layer 55.

It will therefore be appreciated that the total layer structure comprises two solid layer structures which comprise a first material in the form of wool fibre which absorbs acoustical energy (sound) at a first frequency and an air gap layer which has a different frequency of sound absorption from that of the wool layer. The aluminum foil layer 51 also absorbs at different frequencies from the wool fibre layers 49, 53 and the air gap layer 43.

The outwardly facing punched aluminum layers 47 (rear) and 55 (front) do absorb sound energy to some limited extent but primarily act as diffusers.

The layer structures in the embodiment of FIG. 4 are held in place relative to each other by an attachment means, specifically bolts.

Figure 5:
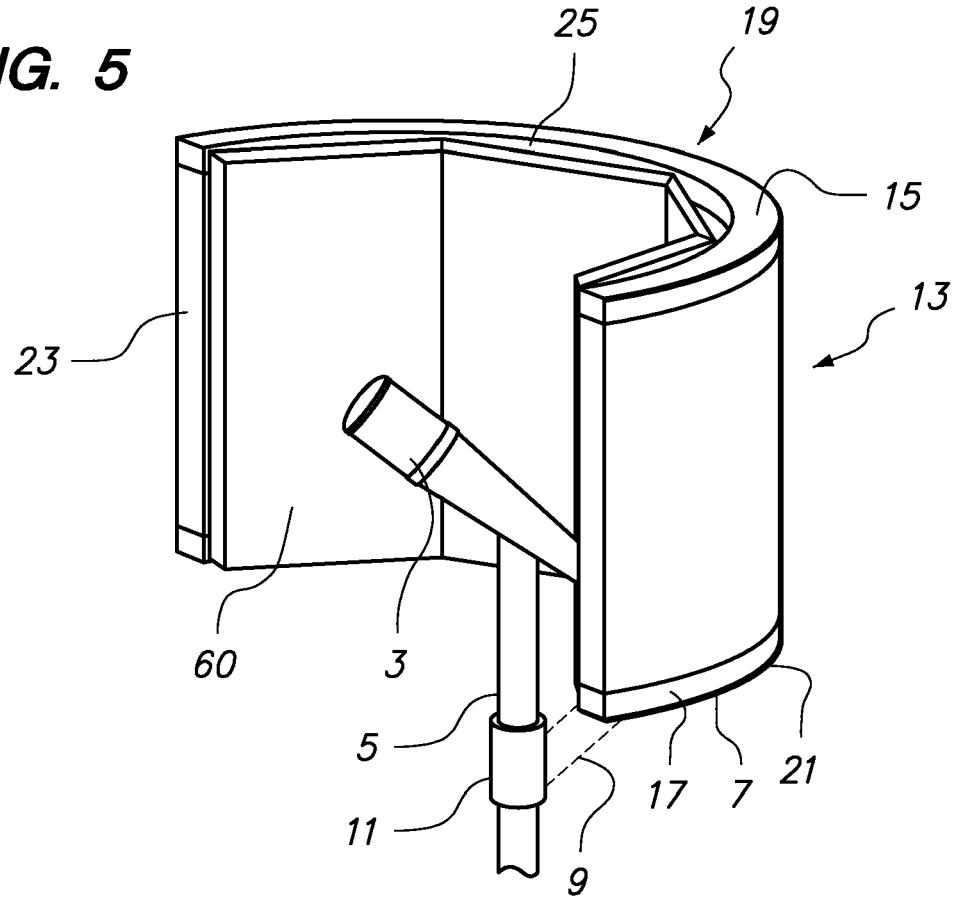
FIG. 5 shows a perspective view illustrating a fourth embodiment of the present invention configured as a half cylinder with a second panel layer of multiple flat panels.

A fourth embodiment is shown in FIG. 5, which is analogous to the embodiment shown in FIG. 1, and therefore, identical reference numerals are used for like integers. In this case, as yet an additional sound absorbing layer, a series of flat panels 60 are attached to the concave face 25 by an attachment means holding the flat panels 60 in place such that an additional air gap layer 65 is defined between the concave face 25 of the composite acoustic absorbing structure 13 and each flat panel 60.

Figure 6:
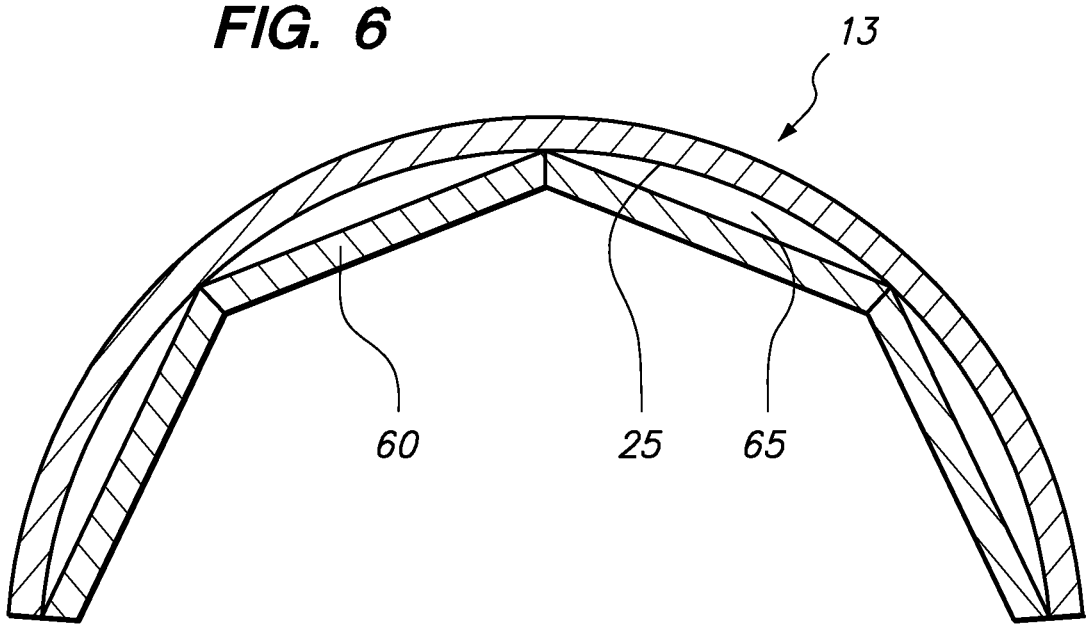
FIG. 6 shows a sectional view illustrating the first panel layer and the second panel layer.

FIG. 6 shows a partial cross section through the acoustical panel shown in FIG. 5. As shown in FIG. 6, an additional air gap layer 65 is defined by the boundaries of each flat panel 60 and the concave face 25 of the composite acoustic absorbing structure 13.

In the light of the foregoing description of preferred exemplary embodiments, variations, modifications of those embodiments, as well as other embodiments, all within the spirit and scope of the appended claims, will not become apparent to those skilled in the art. The present invention is therefore to be understood to encompass all such variations, modifications and other embodiments.

INDUSTRIAL APPLICABILITY

An apparatus consisting of an acoustical panel attached to a microphone thereby allowing the ability to create a low cost near-studio quality recording environment that does not require the acoustical treatment of an entire room.

The invention claimed is:

1. composite acoustic panel for absorbing acoustical sound waves directed at a microphone located proximate to the composite acoustic panel, the composite acoustic panel comprising:

a rear solid layer structure comprising a rear diffusion layer, a first solid sound-absorptive layer and an aluminum layer, the rear diffusion layer being in contact with a first side of the first solid sound-absorptive layer and the aluminum layer being in contact with a second side of the first solid sound-absorptive layer, the second side of the first solid sound-absorptive layer being opposite to the first side of the first solid sound-absorptive layer;

a front solid layer structure configured to be substantially parallel to the rear solid layer structure, the front solid layer structure comprising a second solid sound-absorptive layer and a front diffusion layer, the second solid sound-absorptive layer being in contact with a first side of the front diffusion layer; and an air gap layer located between the rear solid layer structure and the front solid layer structure, the air gap being in contact with the aluminum layer of the rear solid layer structure and the second solid sound-absorptive layer of the front solid layer structure;

and wherein the composite acoustic panel is configured for attachment to a stand or boom of the microphone.

2. The composite acoustic panel of claim 1 wherein the rear diffusion layer is comprised of a perforated material.

3. The composite acoustic panel of claim 2 wherein the perforated material is plastic or metal.

4. The composite acoustic panel of claim 2 wherein the perforated material is punched aluminum.

5. The composite acoustic panel of claim 1 wherein the first solid sound-absorptive layer is comprised of a non woven or other fibrous structure.

6. The composite acoustic panel of claim 5 wherein the non woven or other fibrous structure is comprised of wool fibers, metallic fibers, plastic fibers, or any combination thereof.

7. The composite acoustic panel of claim 1 wherein the first solid sound-absorptive layer is comprised of a foamed material.

8. The composite acoustic panel of claim 7 wherein the foamed material is comprised of a foamed polymer, foamed metal, or any combination thereof.

9. The composite acoustic panel of claim 1 wherein the aluminum layer is comprised of aluminum foil or aluminum film.

10. The composite acoustic panel of claim 1 wherein the second solid sound-absorptive layer is comprised of a non woven or other fibrous structure.

11. The composite acoustic panel of claim 10 wherein the non woven or other fibrous structure is comprised of wool fibers, metallic fibers, plastic fibers, or any combination thereof.

12. The composite acoustic panel of claim 1 wherein the second solid sound-absorptive layer is comprised of a foamed material.

13. The composite acoustic panel of claim 12 wherein the foamed material is comprised of a foamed polymer, foamed metal, or any combination thereof.

14. The composite acoustic panel of claim 1 wherein the front diffusion layer is comprised of a perforated material.

15. The composite acoustic panel of claim 14 wherein the perforated material is plastic or metal.

16. The composite acoustic panel of claim 14 wherein the perforated material is punched aluminum.

17. The composite acoustic panel of claim 1 wherein the front solid layer structure absorbs acoustic energy at a first frequency and the air gap layer absorbs acoustic energy at a second frequency.

18. The composite acoustic panel of claim 1 wherein the rear solid layer structure absorbs acoustic energy at a first frequency and the air gap layer absorbs acoustic energy at a second frequency.

19. The composite acoustic panel of claim 1 wherein the front solid layer structure absorbs acoustic energy at a first frequency, the rear solid layer structure absorbs acoustic energy at a second frequency, and the air gap layer absorbs acoustic energy at a third frequency.

20. The composite acoustic panel of claim 1 wherein the composite acoustic panel is configured as a curvature.

21. The composite acoustic panel of claim 20 wherein the curvature is semicircular, hemispherical or parabolic,

22. The composite acoustic panel of claim 1 wherein the composite acoustic panel is configured as a flat panel.

23. The composite acoustic panel of claim 20, further comprising one or more additional flat acoustical panel located adjacent to a second side of the front diffusion layer of the front solid layer structure, the second side of the front diffusion layer being opposite to the first side of the front diffusion layer, the one or more additional flat acoustical panel creating one or more additional air gap layer between the one or more additional flat acoustical panel and the front solid layer structure.

* * * * *